United States Patent [19]

Columbus

[11] 4,041,995

[45] Aug. 16, 1977

[54] GAS PRESSURE-ACTIVATED DROP DISPENSER

[75] Inventor: Richard L. Columbus, Rochester, N.Y.

[73] Assignee: Eastman Kodak Company, Rochester, N.Y.

[21] Appl. No.: 644,014

[22] Filed: Dec. 24, 1975

Related U.S. Application Data

[63] Continuation-in-part of Ser. No. 545,670, Jan. 30, 1975, abandoned.

[51] Int. Cl.[2] ..... B01L 11/00; B65D 83/14

[52] U.S. Cl. ..... 141/275; 23/253 R; 222/1; 222/23; 222/52; 222/209; 222/401; 222/420

[58] Field of Search ..... 73/61.16, 423 A, 425.4 P, 73/425.6; 23/253 TP, 253 R, 259; 141/250, 275; 222/1, 23, 52, 207, 209, 215, 401, 420, 32, 422

[56] References Cited

U.S. PATENT DOCUMENTS

| | | | |
|---|---|---|---|
| 2,363,474 | 11/1944 | Schlesinger | 222/179.5 |
| 2,680,477 | 6/1954 | Schiya, Jr. | 222/209 X |
| 2,946,486 | 7/1960 | Gilmont | 222/32 X |
| 3,341,087 | 9/1967 | Rosin et al. | 222/422 |
| 3,572,400 | 3/1971 | Casner et al. | 222/420 X |
| 3,934,192 | 1/1976 | Lafour | 222/420 X |

*Primary Examiner*—Robert B. Reeves
*Assistant Examiner*—David A. Scherbel
*Attorney, Agent, or Firm*—Dana M. Schmidt

[57] ABSTRACT

Apparatus and a process for drop-by-drop metering of fluids, especially biological fluids such as blood serum, wherein a removable container having a drop-forming platform is pressurized by apparatus not requiring apparatus contact with the fluid other than via the container. Preferably, a pressure detecting and feed back system can be included to ascertain whether or not the drop-forming sequence has been properly achieved.

32 Claims, 21 Drawing Figures

FIG. 1
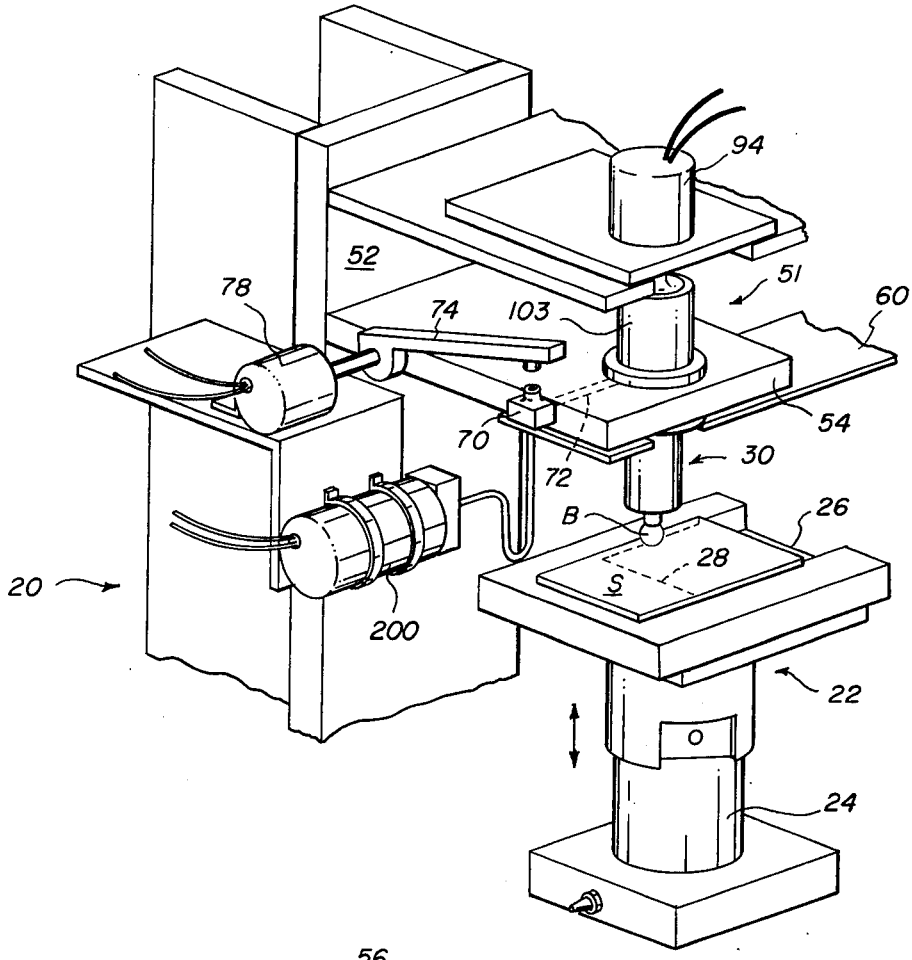
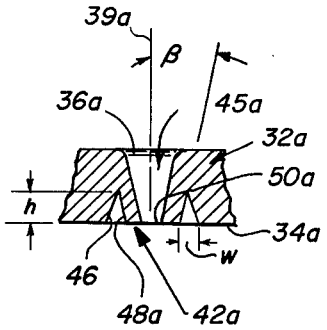
FIG. 4
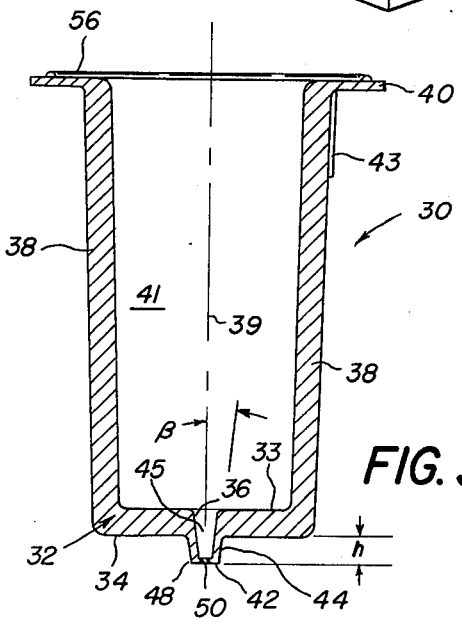
FIG. 3
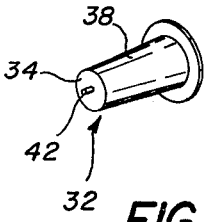
FIG. 2

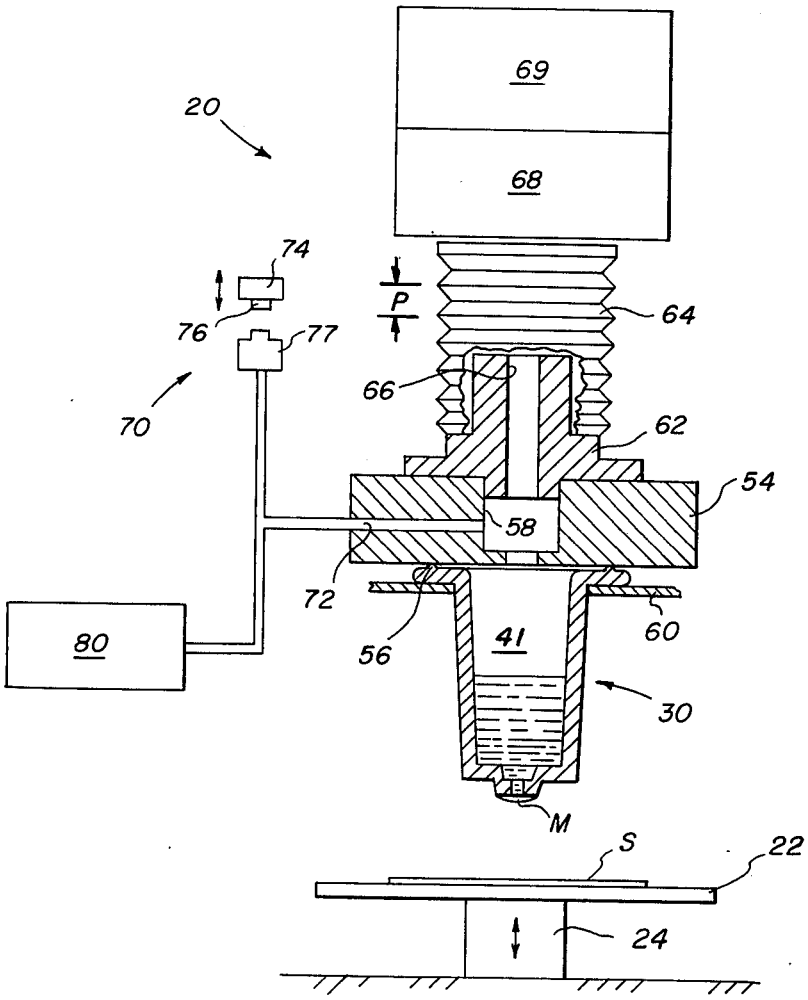
FIG. 6
FIG. 10
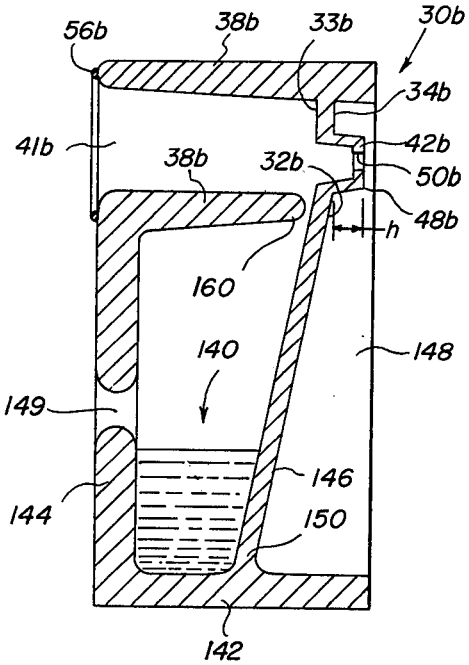
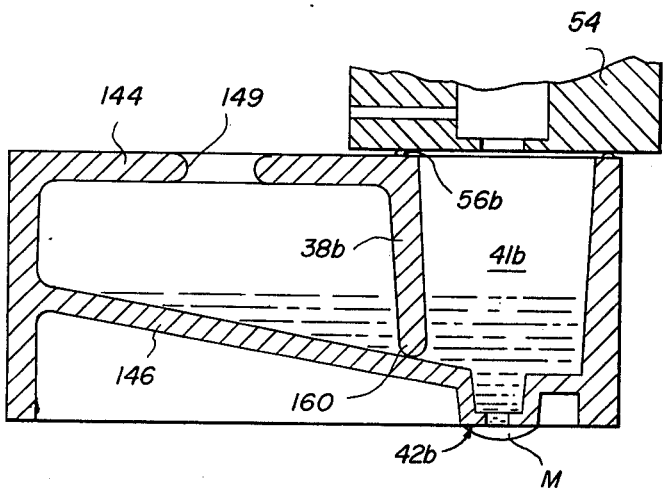
FIG. 11

FIG. 8
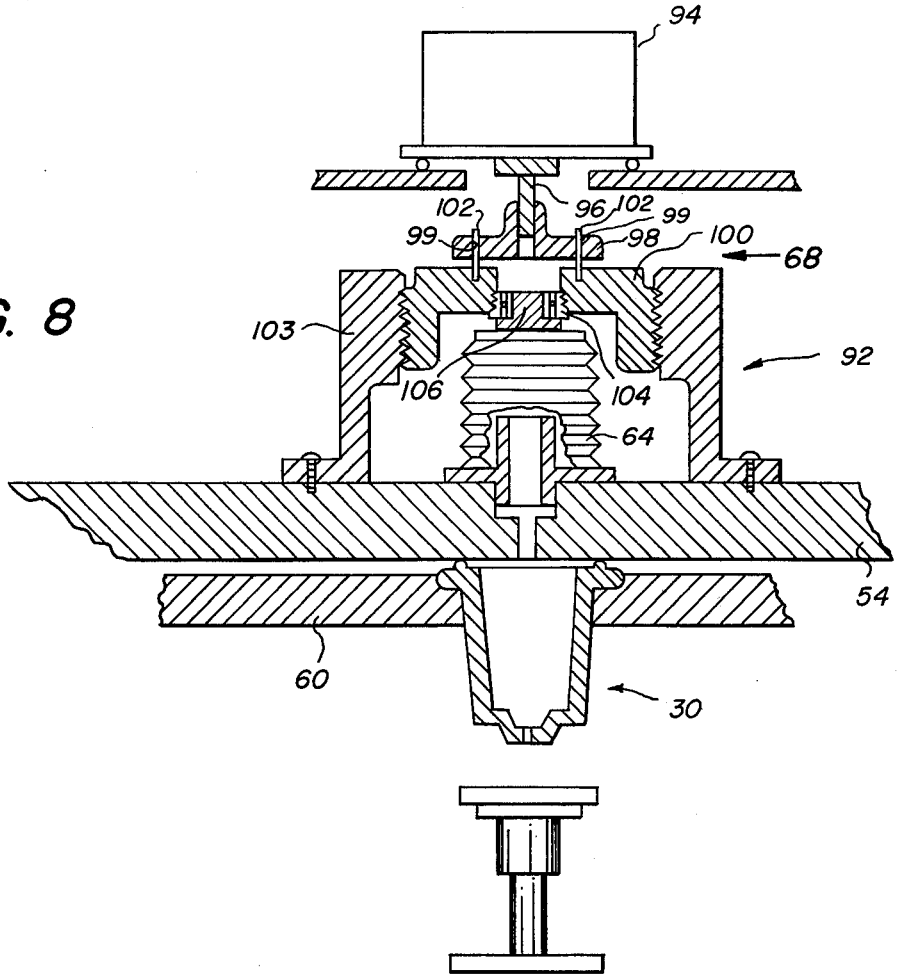
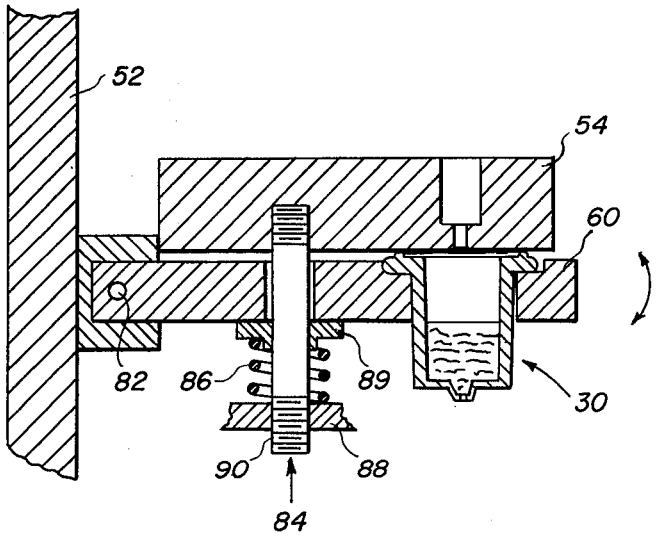
FIG. 7

GAS PRESSURE-ACTIVATED DROP DISPENSER

RELATED APPLICATIONS

This application is a continuation-in-part application of Ser. No. 545,670 filed on Jan. 30, 1975, now abandoned.

BACKGROUND OF THE INVENTION

1. Field of the Invention

This invention relates to apparatus for precise metering of small amounts of fluids, particularly biological fluids, in an environment which dictates that there be no contamination from one sample to the next. Particularly the apparatus is designed for automatic dispensing of uniform amounts of blood sera from different patients onto a plurality of test surfaces, even though the liquid properties of the sera may vary widely from sample to sample in an unpredictable manner.

2. State of the Prior Art

In recent years, a number of automated systems for carrying out quantitative chemical analyses of fluid samples have been developed and these have proven particularly advantageous for use in clinical laboratories; especially in the analysis of blood. Systems based on continuous flow analysis in which sample, diluents and test reagents are mixed together and transported through the analyzer are very widely utilized. However, these continuous analyzers, such as, for example, the analyzer illustrated in U.S. Pat. No. 2,797,149, are complex and expensive, require skilled operators, necessitate considerable expenditure of time and effort in repetitive cleaning operations, and do not permit the use of very small quantities of sample, such as are used in microanalytical techniques. The dispensing of blood or other fluids into the reaction container has been a relatively simple operation only when the system uses liquid analysis exclusively.

Devices have been constructed to permit the metering of small amounts of fluids other than blood serum. U.S. Pat. No. 3,552,605 discloses a hand dispenser which has a vent or valve means for controlling the pressure within the container. However, both precision and automation is lacking, and the device does not contemplate the repetitious dispensing of a plurality of different samples. Apparatus which is automatic and precise is shown in U.S. Pat. No. 3,572,400, wherein a pen-like device deposits a high viscosity magnetic fluid on a substrate a drop at a time, in response to pressure delivered by a piston in contact with the magnetic fluid. However, such apparatus is not suitable and was not designed for the handling of blood sera, because the contact between the pressurizing means and the fluid either will contaminate the next sample, or require an inordinate amount of cleaning between samples.

The precise dropwise metering of other non-biological fluids onto a substrate is shown, for example, in U.S. Pat. Nos. 3,164,304; 3,341,087; and 3,810,779. However, because of the peculiar properties of blood sera and the need to dispense different samples from different sources one after another without contamination, such apparatus does not meet the requirements of this invention.

Patents relating to the pressure metering of liquids by the alteration of the volume of a container such as a bellows include U.S. Pat. Nos. 194,010; 2,665,825; 3,323,689; and 3,618,829. These, however, are not designed to provide the precision required for biological fluids. Patents showing such metering by means of a piston mechanism such as a syringe include U.S. Pat. Nos. 2,946,486; 3,367,746; and 3,615,240.

Cup-like devices have been constructed for the dispensing of a variety of liquids including blood sera. Representative examples include those described in U.S. Pat. Nos. 1,326,452; 2,204,471; 2,586,513; 2,802,605; 3,449,081; 3,106,845; 3,460,529; 3,540,857 and 3,832,135 (FIGS. 22 and 23). In the case of blood sera, these devices do not provide repetitive dispensing of microsized drops substantially uniform in volume, regardless of variations in surface tension and viscosity that may be characteristic of blood sera taken from different patients. That is, these devices do not contemplate both (1) the formation of precise droplets as small as 1–30 $\mu$l and/or (2) the use of the same container design for the dispensing of a variety of samples demonstrating varying properties.

Metering of serum by pressurizing the air above a container to force $10^{-4}$ liters of serum out through a siphon is shown, for example, in U.S. Pat. No. 3,650,437. However, the siphon is not properly constructed to permit the formation of pendant drops. Instead, the serum is ejected from the siphon onto a laboratory slide.

Other devices have been developed for dispensing blood sera, but little attention has been directed to the provision for repeated accuracy in such dispensing. Instead, sample size is controlled by treating the substrate upon which the blood serum is dispensed. Examples of such devices include those disclosed in U.S. Pat. No. 3,036,893.

Patents pertinent only to the background of dispensing containers in general include U.S. Pat. Nos. 2,058,516; 2,363,474; 2,598,869; 2,599,446; 2,721,008; 3,141,574; 3,190,731; 3,300,099; and 3,645,423.

OBJECTS OF THE INVENTION

It is an object of the invention to provide apparatus and a process for the repeated, precise dispensing of micro-sized drops of fluid, which will give generally the same drop volume in spite of substantial variations in the physical properties of the fluid samples to be dispensed.

It is a related object of the invention to provide such an apparatus and process which avoid sample to sample contamination.

Another related object of the invention is to provide disposable fluid dispensing containers for use in such apparatus and process.

A further object of the invention is to render such apparatus and process self-monitoring. More precisely, it is an object of the invention to provide such an apparatus and process for the automatic detection of the failure of a drop to be dispensed, thereby permitting automatic shut-down of the apparatus.

Yet another object of the invention is to provide such apparatus which does not require prewetting before the first drop is dispensed.

Other objects and advantages will become apparent from the following Summary and Description of the Preferred Embodiments, when considered in light of the attached drawings.

SUMMARY OF THE INVENTION

The invention concerns a metering or dispensing apparatus and process for repetitive, precise, dropwise dispensing of micro-amounts of sample fluids from different sources wherein the fluid properties may vary from one sample to the next. Such metering requires that there be complete freedom from contamination as the samples are changed. More specifically, there is provided apparatus for dispensing fluids onto a substrate, comprising a support for the substrate; a container provided with a platform at the bottom thereof suitable for the formation of stable, pendant drops, the platform having an aperture permitting forced fluid flow from the interior of the container, the maximum dimension of the aperture being sufficiently small to prevent flow of the fluid under gravity; mounting means for mounting the container spaced away from and above the support; a passageway in fluid communication with the interior of the container; means fluidly connected to the passageway for generating a pressure above ambient within the passageway; the pressure generating means and the container mounting means being free from contact with the fluid being dispensed; valve means permitting selective venting of the passageway to the atmosphere; and moving means for providing relative motion between the support and the container, whereby a drop formed on the platform by the generating means is deposited on the substrate by relatively moving the container and the substrate to a position which brings into contact the drop and the substrate. The container in such apparatus preferably comprises a compartment having a capacity for the fluid sufficient to permit at least one drop to be dispensed therefrom, the compartment being defined by walls having inner and outer surfaces, one of the walls providing a platform on said outer surface, the platform having an aperture therein in fluid communication with the compartment and of dimensions which preclude gravity flow of the fluid from the container and a drop-supporting surface defining a drop-wettable area which will support a completely-formed, pendant drop of predetermined volume, the volume being substantially fixed and within the range of about 1 and about 30 $\mu$ 1; the platform being constructed in a manner which is sufficient to prevent the spreading of drops of dispensed fluid from the platform surface.

Thus, there is provided a process for the precise dispensing onto a substrate of metered amounts of fluids having a surface tension within the range from between about 35 dynes/dm to about 75 dynes/cm, the process comprising the steps of depositing the fluid in an open-top container having a dispensing aperture the maximum dimension of which is less than that which will permit gravity flow of the fluid, pressurizing the top of the container and thus the fluid in an amount sufficient to form a pendant drop outside the container at the aperture, and, while maintaining the container stationary, moving the substrate into contact with the drop but not the container, so as to cause removal of the drop onto the substrate.

BRIEF DESCRIPTION OF THE DRAWINGS

FIG. 1 is a fragmentary isometric view of apparatus constructed in accordance with the invention;

FIG. 2 is a perspective view of a serum container constructed in accordance with the invention;

FIG. 3 is an elevational view in section of the container of FIG. 2;

FIG. 4 is an enlarged fragmentary sectional view similar to FIG. 3, but illustrating an alternate embodiment;

FIG. 6 is a partially schematic elevational view in section of a portion of the apparatus of FIG. 1;

FIG. 7 is a fragmentary elevational view in section illustrating additional portions of the apparatus;

FIG. 8 is a sectional view illustrating a drive means for the pressurizing portion of the apparatus;

FIGS. 10–11 are sectional views of an alternate embodiment of the container, shown in two sequential operating positions;

DESCRIPTION OF THE PREFERRED EMBODIMENTS

Figure 17:
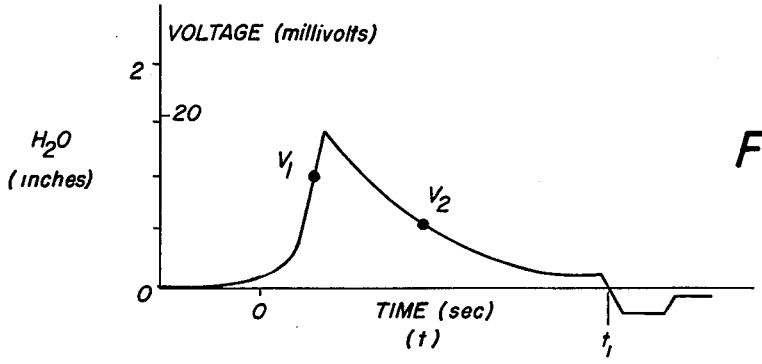
FIG. 17 is a chart illustrating the pressure-time relationship of a normal drop sequence, as sensed by the failure mode detector.

The invention is intended for use in the dispensing of drops of blood sera onto suitable substrates, for clinical analysis. Typical of such substrates are those shown, for example, in commonly owned U.S. Application Ser. No. 588,755, entitled "Improved Multilayer Analytical Element Analysis", filed by B. Bruschi on July 20, 1975; and commonly owned Belgian Pat. No. 801,742, granted on Jan. 2, 1974. However, the apparatus of this invention is neither limited to use with just such substrates, nor to just the dispensing of blood sera, as other fluids can be used with apparatus of the type disclosed. Although blood sera is described hereinafter by way of example, the apparatus may be used to dispense fluid in any repetitive dispensing operation which requires that the amount of dispensed fluid be uniform in spite of substantial variation in physical properties of the fluid samples so dispensed. When discussed in terms of that which is dispensed, unless otherwise stated, "fluid" is used to mean a fluid capable of forming drops.

Terms such as "up", "down", "lower" and "bottom" as used herein refer to orientations of parts when the apparatus is positioned in its customary position of use.

The sera to be dispensed is to be tested by devices requiring very accurate, but very small amounts. Such predetermined drop volumes are substantially fixed and, depending on the surface area of the drop-supporting platform, range from 1 to about 30 microliters, and preferably between about 8 and about 13 microliters. Not only do such small amounts permit substantial reduction in equipment size, they also serve to permit multiple testing of a relatively small amount of total blood serum. In this case of elderly or infant patients, only small amounts of blood are available for testing; and, the smaller the individual test drop, the greater the number of tests which can be run on a given small amount of blood. Furthermore, it will be readily appreciated that, regardless of drop shape, each drop ideally should be of substantially uniform volume, as otherwise the testing equipment may require recalibration to reflect increased or decreased volume. Preferably, the volume should not change more than about 5% from a selected value.

Additionally, it is desirable that the diameter of the drop be controlled, due to the limited area of the substrate which is designed to receive it.

A final factor which further complicates the preceding requirements is that the blood serum is susceptible to wide variations in surface tension and viscosity, as discussed hereafter, due to patient variations and/or various disease conditions.

Turning now to FIG. 1, in accordance with one aspect of the invention, the apparatus 10 for the dispensing of fluids such as blood sera B onto substrate S comprises a support 22 for the substrate which is raised and lowered by means such as hydraulic cylinder 24; a container 30; a pressure generating means 51 supported by a frame 52, for pressurizing the interior of container 30; a container mounting means comprising a sealing arm 60 holding the container in sealed position with respect to the pressure generating means; a vent 70 in fluid communication with the pressure generating means; a vent actuating means 78 for selectively operating the vent; and a pressure-sensing failure mode detector which includes a pressure transducer 200. The support 22 for the substrate may be shaped to receive and hold the substrate in proper alignment, as by the provision of a recess 26 terminating in a shoulder 28 against which the substrate is positioned. Suitable transfer means, not shown, automatically feed and remove the substrates to and from the support 22. The substrate is shown to be a discrete chip or slide, but it will be appreciated that the apparatus can be suitably modified to receive continuous web forms.

Turning now to FIGS. 2 through 4, in accordance with another aspect of the invention, container 30 preferably comprises a cup-like device having a bottom wall 32 with opposed faces 33 and 34, and an aperture 36, opposed side walls 38 extending from face 33 of the bottom wall and terminating in a shoulder 40 to define a first compartment 41, and a specially constructed platform 42 formed as a portion of the bottom wall, preferably spaced away from and connected to face 34 of the bottom wall. By "platform", it is meant any surface suitable for supporting a localized drop prior to detachment onto a support. Indicia means such as a label 43 can be provided on any exterior portion of the container, such as walls 38. A convenient shape of the walls 38 provides a generally conical form having an axis 39, but other forms are obviously as useful. Because the preferred use of the invention is to dispense a plurality of drops one at a time, for analysis, it is essential that the compartment 41 have a capacity sufficient to accommodate all the drops to be tested without refilling. Specifically, due to the large number of tests normally run on a single sample, the compartment preferably has a capacity which is equal to at least about 100 $\mu$ 1, and which can be as much as about 1200 $\mu$ 1.

The platform 42 is generally a flat surface and can be formed as a separate wall surface which is joined by a connecting surface or walls 44 to the rest of the container 30, FIG. 3. The platform also has an aperture 50 or 50*a* in fluid communication with compartment 41 via aperture 36 or 36*a*.

The platform 42 and the wall 32 have a connection which spaces away the platform from adjacent surfaces. The geometry and dimensions of the connection preferably are sufficient to permit the formation on the platform of stable, pendant drops. That is, the preferred connection of the platform with the bottom wall is a connecting surface which spaces the platform away from the remaining container portions by a distance "h" which is sufficient to prevent a drop of blood sera from spreading from the platform to remaining portions of wall 34 prior to drop transfer. Such drop spreading would interfere with accurate drop transfer. It has been found that, for the fluid discussed below, a suitable value for this distance "h" is about 0.05 inches (0.127 cm) when materials of the type described below are used in the fabrication. Lesser values for "h" can be used, but these tend to cause deterioration of drop pendency such as by apparatus vibrations or the dynamic interaction betweem the substrate and the drop when drop removal is achieved by contact with the substrate. Factors tending to reinforce the drop pendency would be a radius of curvature for edge 48 which is considerably less than the maximum preferred value of 0.02 cm.

An alternate form of the platform is illustrated in FIG. 4. Parts similar to those previously described bear the same reference numeral with the identifying letter "*a*" appended thereto. Here, the platform 42*a* is isolated from the rest of face 34*a* by an annular groove 46 having a height "*h*" and a width "*w*". The value of "*h*" is generally the same as for the embodiment of FIG. 3, while width "*w*" should be at least about 0.05 cm, and preferably about 0.127 cm for the fluids discussed below.

In either embodiment, the geometry of the connecting surface which forms either the walls 44, or the groove 46 immediately adjacent to the platform, is such that wall 44 or groove 46 preferably is sloped away from the line of force along which gravity attracts the drop of serum, when formed on the platform, by an angle $\beta$ which keeps the drop confined fo the platform. For the configuration shown, it is preferably less than about 15°, the line of force coinciding with the longitudinal axis 39 or 39*a* of the container. Any slope greater than this will encourage the drop formed on the platform to spread up the walls 44 or groove 46, thus interfering with the proper drop size and drop removal. Negative values of $\beta$ are also acceptable, so that the connecting surface or wall 44 diverges, instead of converges, from bottom wall 32 to platform 42. Assuming then that, in use, platform 42 is horizontally oriented, as is preferred, the wall 44, or groove 46 if used, defines with respect to the platform exterior surface an angle which is no greater than about 105°.

To insure that blood serum of the types commonly received from patients are properly dispensed as a drop from the platform, in accurate micro-amounts, other geometrical features which the container 30 preferably has are the additional following properties, regardless of which embodiment the platform takes:

1. Aperture 50 preferably has a maximum dimension, measured transversely to fluid flow therethrough, which is less than that which will permit flow of blood serum under the influence of gravity and which is large enough to retard closure of the aperture by protein agglomeration. To perform this function with blood sera having a surface tension of between about 35 cynes/cm and about 75 dynes/cm, and a relatively viscosity between about 1.2 and about 2 centipoises, it has been found that the maximum dimension preferably is between about 0.023 and about 0.045 cm. The upper value can be increased if the head of fluid is correspondingly decreased as would be the case if the container diameter were increased. A typical head of fluid for such a maximum aperture dimension is 2.29 cm. A particularly useful embodiment is one in which the aperture is generally circular in shape, with the circle diameter being 0.038 cm.

2. It is also preferred that the intersection of the aperture with the platform surface be essentially a sharp edge, i.e., having a radius of curvature no greater than about 0.02 cm, and that it be free of protrusions such as portions of flashing, which would project either away from the platform or into the fluid passageway. Without such precision in the formation of the aperture, capillary effects would be created tending to cause premature fluid flow.

3. The transition zone between platform 42 and the connecting surface such as walls 44 defines an edge 48 which preferably is sufficiently sharp as to prevent the tendency of the serum drop to climb up the walls 44 or notch 46 under the influence of surface tension. For the range of fluids anticipated, it is preferred that the maximum radius of curvature to achieve such an effect, does not exceed about 0.02 cm.

The effect of the preceding features is to confine the drop dispensed from the container 30 to the surface of the platform 42. It will be appreciated that the entire exterior surface of the platform is wetted by the drop, and because the drop naturally assumes a quasi-spherical form, the contacted surface area of the platform will range from about 0.0026 sq. cm. for a 1 $\mu$ 1 drop, to about 0.018 sq. cm. for a 30 $\mu$ 1 drop. This represents a range in platform diameter, between edges 48, which is between about 0.05 cm and about 0.15 cm. The particular surface area chosen will of course dictate the volume of the completely formed drop, such volume being substantially fixed for all pendant drops dispensed from that chosen surface area. Alternatively, the surface supporting, and wetted by, the drop can be increased for a given drop volume and platform diameter by either (1) forming a downwardly projecting rim around edge 48, (2) making the platform surface concave, or (3) roughening the surface of platform 42. Without such roughening, it has been found that a preferred surface smoothness is between about 1 to 30 micro inches RMS.

The walls 32 and 38 preferably are strong enough to withstand, without undergoing permanent deformation, the forces incident in the handling of the container. In view of the fact that the automatic feeding of the container 30 into the disclosed apparatus is contemplated, the forces which should be resisted include pressures as great as 0.137 K/cm$^2$.

To assist in drop detachment and to minimize protein agglomeration in aperture 50, the platform 42 of the embodiment of FIG. 3 preferably has a cross-sectional thickness, measured along a plane extending perpendicular through the platform, which is no greater than about 0.025 cm. A particularly useful thickness is about 0.0127 cm. The effect of such a construction is to minimize the neck of fluid connecting the drop to the main volume in compartment 41. This in turn permits rapid detachment with little secondary flow out of the container. Alternatively, FIG. 4, aperture 36*a* can be such as to blend into aperture 50*a* by a smooth wall which obviates the need for a separate wall thickness in the platform. In such a case, it is preferable that the dimension for the aperture 36*a* of compartment 45*a* be considerably greater than that of aperture 50*a,* to avoid presenting to the serum a long constriction capable of protein agglomeration. This can be achieved by an angle of conversion from aperture 36*a* to 50*a* which is no less than about 5°.

Figure 5A:
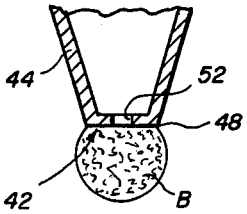
FIGS. 5A through 5C are enlarged fragmentary sectional views similar to FIG. 4, FIGS. 5B and C illustrating improper configurations.
Figure 5B:
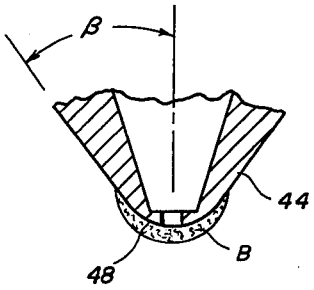
Figure 5C:
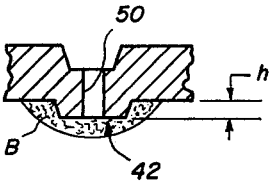

FIGS. 5A through C illustrate the importance of the preceding features on drop formation. In FIG. 5A, all of the features of platform 42 have been constructed pursuant to the invention, and the drop is properly and completely formed, having a predictable and repeatable size and configuration. As used herein, "completely formed" means the volume and shape the drop assumes while pendant from platform 42, after the pressure generating means hereinafter discussed is fully actuated. In FIG. 5B however, the edges 48 are rounded so as to have a radius of curvature considerably larger than 0.02 cm, and the value for angle $\beta$ exceeds 15°. The resultant drop has spread up the walls 44 so as to deposit on the substrate over a much larger area that it would if properly formed. In FIG. 5C, the value of "*h*" has been reduced well below 0.127 cm, and again the drop B has spread beyond the platform to give an improperly large diameter. Further, the drop location relative to aperture 50 is unpredictable. In both of the examples of FIGS. 5B and 5C, drop detachment takes a longer time and more energy due to the increased surface area of contact. Such delay in detachment tends to cause secondary flow from the reservoir in compartment 41. Secondary flow will alter the volume of both the first drop detached, as well as that of subsequent drops.

Alternatively, the entire bottom wall 32 can comprise platform 42 provided however the exterior surface of the wall in that case conforms with the requirements set forth above concerning platform surface area, and otherwise satisfies the requirements described above for preventing spreading of the drop away from the platform. Furthermore, the container can be constructed such that the bottom wall 32 and the side walls 38 flow together as extensions of each other.

It will be readily appreciated that, in view of its simplicity, container 30 is economically disposable after a single sample has been dispensed therefrom in as many repetitive dispensing operations as may be necessary. It is this feature which avoids the necessity of cleaning the apparatus after each use.

All of the above features can be obtained by forming the container 30 out of copolymers such as acrylonitrile-butadiene-styrene (ABS), and polymers such as acetal, polypropylene, polystyrene, high density polyethylene and polyesters. A typical thickness for walls 32 and 38, in the case of ABS copolymers, is for example about 0.08 cm. In such a construction, the value of $\beta$ is about 6°, the radius of curvature of edge 48 is about 0.01 cm, and the platform thickness is about 0.013 cm.

It has been found that a container 30, constructed as described above, when the contents are pressurized as hereinafter described, will give substantially uniform volumetric drops of biological fluid repeatedly, such as blood sera, even when the relative viscosity, surface tension and total protein content varies drastically as is characteristic of blood sera drawn from diseased and healthy patients. Such control of volume is essential to insure that the same potential for the tested component exists in each drop. Otherwise, a variation in drop volume can produce, depending on the test which is conducted and the substrate on which the drop is deposited, a falsely varient reading for the component. Table 1 sets forth the results, wherein the drop volume was selected to be between about 10 and about 13 μl. "X" represents the arithmetic mean in a series of tests an "COV" is the coefficient of variation, measured in the usual manner of statistical analysis. As is shown, drop volumes varied only about 2% from the average, even for biological fluids other than serum, such as Ringer solutions, water, urine and cerebrospinal fluids.

Although the blood sera tested was found to have a relative viscosity that did not exceed about 2.0, it is contemplated that similar dispensing performance will occur in the use of container 30 when extreme conditions exist in samples taken from patients whose health states induce high viscosity syndromes.

Table 1

COMPARATIVE SUMMARY OF SEVERAL BIOLOGICAL FLUIDS

| Describing Parameter \ Test Fluid | Proteinaceous Solutions: Blood Sera | Calibrated Reference Serum | Ion-Free Calibrated Reference Serum | Urine | Cerebro-spinal Fluid | Non-Proteinaceous Solutions: Triple Distilled $H_2O$ | Ringer Solution |
|---|---|---|---|---|---|---|---|
| Surface Tension (dyn/cm) | 44–63 | 45.8 | 61.0 | Not tested | Not tested | 70.0 | 66.2 |
| Relative Viscosity | 1.2–1.9 | 1.5 | 1.7 | 0.95–1.1 | 0.94–1.2 | 1.0 | .91 |
| Total Protein (gm/100 ml) | 4.1–11.8 | 7.1 | 5.77 | 1.0 | 1.2–5.0 | 0 | 0 |
| Data Points | 225 | 15 | 10 | 64 | 20 | 10 | 10 |
| SPOT AREA | | | | | | | |
| $\bar{X}$(μm²) | 87.3 | 87.3 | 89.3 | Not tested | Not tested | 111.0 | 104.4 |
| COV (%) | 2.2 | 1.9 | 1.4 | | | 1.9 | 2.6 |
| SPOT VOLUME | | | | | | | |
| $\bar{X}$ (μl) | 10.2 | 10.2 | 10.5 | 10.0 | 10.0 | 13.1 | 12.3 |
| COV (%) | 2.3 | 2.0 | 1.4 | 2.0 | 2.0 | 2.0 | 2.7 |

In the preceding table, the blood sera was obtained from while blood samples taken on a random basis from various human patients, including diseased patients. The Ringer Solution was isosmotic 0.9% NaCl in water. The "calibrated reference serum" was "Versatol", provided by General Diagnostics, a division of Warner-Lambert Co. The assay for "Versatol" serum is given in Table 2.

Table 2

| Constituent | "Versatol" Serum Amount |
|---|---|
| Bilirubin | 0.5 mg/100 ml |
| Calcium | 10.2 mg/100 ml |
| Chloride | 103 mEq/L |
| Cholesterol, total | 170 mg/100 ml |
| Creatinine | 1.7 mg/100 ml |
| Glucose[1] | 81.0 mg/100 ml |
| Iron | 143 mcg/100 ml |
| Magnesium | 2.2 mg/100 ml |
| Phosphorus, inorganic | 4.0 mg/100 ml |
| Potassium | 5.0 mEq/L |
| Protein Bound Iodine | 7.2 mcg/100 ml |
| Sodium | 140 mEq/L |
| TIBC (Total iron binding capacity) | 397 mcg/100 ml |
| Total Nitrogen | 1192 ml/100 ml |
| Total Protein[2] | 7.1 gm/100 ml |
| Urea Nitrogen | 12.2 mg/100 ml |
| Uric Acid | 3.3 mg/100 ml |

[1]Actual glucose recovered by methods such as glucose oxidase or Nelson-Somogyi.
[2]Calculated as [(total Nitrogen)-(Non-protein nitrogen)]× 6.25.

The ion-free calibrated reference serum was "Chemvarion", produced by Clinton Laboratories. Table 3 sets forth the assay for this test fluid.

Table 3

| Constituent | "Chemvarion" Range Found (per 100 ml) | Mean (per 100 ml) |
|---|---|---|
| NPN (Non-protein nitrogen) | N.A. | 36 mg |
| Total Nitrogen | N.A. | 960 mg |

Table 3-continued

| Constituent | "Chemvarion" Range Found (per 100 ml) | Mean (per 100 ml) |
|---|---|---|
| Total Protein | (TN-NPN) × 6.25 | 5.77 gms |
| Protein-bound Iodine | 2.5–2.8 mcg | 2.65 mcg |
| Cholesterol | 135–149 mg | 142 mg |
| Iron, Total | 79–106 mcg | 92 mcg |
| Magnesium | N.A. | nil |
| Copper | 34–43 mcg | 39 mcg |
| The following determinations were made by adding back pure standard concentrates in recovery experiments | | |
| Sodium | — | nil |
| Potassium | — | nil |
| Calcium | — | nil |
| Chloride | — | nil |
| Urea Nitrogen | — | nil |
| Uric Acid | — | nil |
| Phosphorous | 0.1–0.3 mg | 0.2 mg* |
| Glucose | — | nil |
| Creatinine | — | nil |
| Lithium | — | nil |

*Probably protein-bound and liberated during determination.

FIG. 6 illustrates one manner in which the container 30 can be mounted and pressurized within the apparatus 20. That is, the container is removably held in a sealed manner against a plate 54 by arm 60, a rim 56 being provided on container 30 to assist in the maintenance of the seal. The plate in turn is provided with at least one cavity 58 generally aligned and in fluid communication with the interior of the container 30. Screwed into the cavity is a support nipple 62 upon which is mounted volume-alterable means such as a bellows 64. A central passageway 66 in the nipple places the bellows in fluid communication with the interior of the container. To generate an air pressure above ambient within the nipple passageway, cavity 58, and the interior of the container 30, a reciprocating member 68 powered by drive means 69 is positioned in contact with the top portion of the bellows.

An additional passageway 72 extends from cavity 58 in plate 54 to the vent 70, which also is in fluid communication with failure mode detector 80. The vent can be operated by motor 78, FIG. 1, and an arm 74 which lifts a valve 76 off a valve seat 77, FIG. 6. Any suitable valve structure can be utilized. It can be located in plate 54, and as used herein, "valve" encompasses any type of closure device.

Venting is found to be important for several reasons. It insures a uniform datum base for pressurization of compartment 41 for the dispensing of each subsequent drop. Without such a base, elaborate feedback would have to be provided to ascertain the constantly changing pressure conditions of the compartment. In addition, it serves to retard plugging of aperture 50 in container 30. That is, during drop removal by touch-off on substrate S, a negative pressure develops, as shown in FIG. 17 for "$t$" equal to $t_1$. This pressure apparently represents a removal of more than just the external drop, so that the meniscus is moved back into the aperture 50. It has been further found that unless the meniscus is returned to a position exterior to platform 42, as shown for example in FIGS. 6 and 11, closure by protein agglomeration is apt to occur. Venting the interior of the container to atmospheric pressure is adequate to return the menisus "M" to the exterior location as shown in FIG. 6.

The arm 60 is mounted, FIG. 7, about a pivot 82 on frame 52, and biasing means 84 are provided to urge the arm and its captive container 30 upward against the plate 54. For example, a compression spring 86 can be mounted between a threaded, fixed collar 88 and a slidable collar 89 all of which coaxially ring a stud 90 to provide the sufficient bias.

The bellows 64 can be any conventional construction, such as is made by Mechmetal Corp., so long as repeated collapsing can be achieved without loss of pressure. To produce a 10 μl drop, typical constructions capable of producing an increase in pressure of up to 2 inches of water with a stroke of between about 0.4 and about 0.6 cm, have an overall height of between 1.0 cm and 1.5 cm; an outside diameter of between about 0.85 cm and about 1.1 cm; a pitch P, FIG. 6, of about 0.13 cm; a wall thickness of between about 0.002 cm and about 0.003 cm; and a spring constant less than about 1800 grams/cm. Such bellows has an effective area between about 0.387 and about 0.645 square cm.

Motor 94, FIG. 8, preferably is the type which does not return to the zero position after each advance but rather continues to "advance" or rotate with each drop so that generally the same pressure increase is utilized to dispense subsequent drops for maximum precision. Alternatively, and particularly in large numbers of drops are required, motor 94 can be designed to return to the zero position, allowing the use of single step bellows. The result is reduced stroke length and reduced total apparatus air volume.

Referring again to FIG. 6, it will be appreciated that the total air volume comprising the volume of compartment 41 above the free height of the fluid, and the volume of the pressurizing means, including cavity 58, passageway 72, and passageway 66 should be minimized to permit, for a preselected reduction in volume, a corresponding pressure increase sufficient to form the first and successive drops. For 250 μl of fluid in container 30, and a single step bellows, a typical example of such minimum total air volume is about 1.5 cc. It has been found that this control over total air volume permits the first drop to be formed with a volume substantially the same as subsequent drops, thereby avoiding the need for prewetting.

FIG. 8 illustrates a typical means for driving the reciprocating member 68, thus altering the volume of bellows 64. That is, reciprocating member 68 can comprise a rotary-to-linear converter 92 and the drive means can be a rotary stepper motor 94 connected to the converter by a drive shaft 96. More specifically, the converter 92 comprises a plate 98 having two apertures 99 formed in opposed positions offset from shaft 96, an externally threaded member 100 to which are secured two studs 102 which are slidably mounted through the apertures 99 in plate 98, and a female-threaded stub cylinder 103 within which the member 100 can advance and retract. The member 100 is secured to a bearing support 104 mounted on a stub axle 106, extending from the top of the bellows 64. Rotation of motor 94 causes the male member to advance or retract, depending on the direction of rotation, thus providing the necessary stoke to the bellows.

Figure 9:
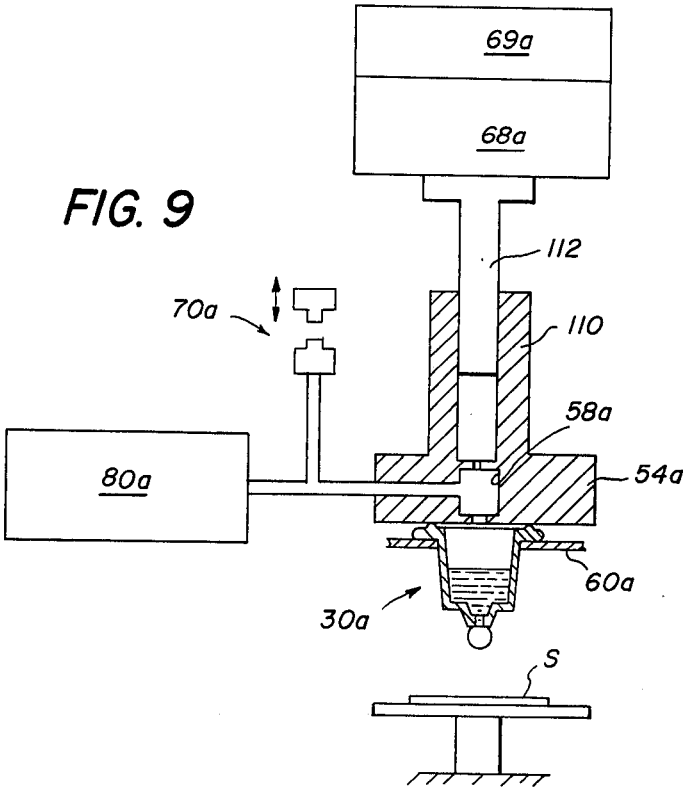
FIG. 9 is a partially schematic view similar to FIG. 6, but illustrating an alternate embodiment thereof.

Turning now to FIG. 9, there is illustrated an alternate embodiment of the pressure generating means. Parts similar to those previously described, FIGS. 6–8, bear the same reference numerals to which the distinguishing suffix "*a*" has been added. Thus, the container **30*a* is removably held against the plater 54*a* by arm 60*a* as before, a vent 70*a* and a failure mode detector 80*a* being fluidly connected to a cavity 58*a* in plate 54*a*, a drive means 69*a* actuating a reciprocating member 68*a*, all as in the previous embodiment. However, plate 54*a* has been modified so that, instead of a bellows rising therefrom, the means fluidly connected to the passageway is a postion disposed in the passageway. A cylinder 110 extends from the plate and a piston rod 112 is reciprocally mounted therein, the cylinder being in sealed communication with the container 30*a*. Actuation of member 68*a* causes the rod 112** to advance, thus modifying cavity volume and pressurizing the container. A typical example of such a construction for the generation of a 10 μl drop is a pipette assembly having a cylinder internal diameter of about 0.310 cm, and a rod stroke of about 0.13 cm.

Other pressurizing means can be used, such as diaphragms and contractible thin wall tubes, as well as those not requiring an alteration of the volume. Typical examples of the latter include pressurizing pumps.

Regardless of the type of pressurizing means used, it is essential that the plate 54, the bellows or piston assembly and the vent passageways be free of contact with the serum if sterility and noncontamination is to be maintained. The removability of the container 30 to make place for another such container having the next sample to be dispensed permits such a construction. Only an air column is used to force the serum out of the container.

It will be appreciated from the foregoing that this apparatus permits dispensing of the fluid by means of only very small pressure increase, which in no event need to exceed 3 inches of water for a 10 μl drop volume.

Still other containers can be used to dispense the serum from the apparatus shown in FIGS. 6–9. These are the alternate embodiments shown in FIGS. 10 through 15. Parts similar to those previously described bear the same reference numerals to which the distinguishing suffixes "*b*", "*c*" and "*d*" have been appended. Thus, in FIGS. 10 and 11, the container **30*b* has a first compartment 41*b* defined by opposed walls 38*b* extending from one face 33*b* of an end or bottom wall 32*b*, and a platform 42*b* spaced away from and connected to the opposite face 34*b* of the wall 32*b*,** all as with the previously described container. The platform has a spacing, "*h*", aperture **50*b* and edges 48*b* preferably all as described above, and may be either of the forms shown in FIGS. 3 and 4. In addition, however, the container is provided with a second compartment 140 having a wall 38*b* in common with compartment 41*b*. More specifically, the container 30*b* is preferably a member having the two compartments defined by the exterior walls 142, 144, 146, 148 and 38*b*, with one wall 38*b* dividing it into the two compartments. An entrance aperture 149 in wall 144 permits serum to be poured or otherwise introduced into compartment 140. Wall 146 preferably slopes from its juncture 150 with wall 142, towards the bottom wall 32*b* of compartment 41*b*. An annular sealing rim 56*b* surrounds compartment 41*b* on wall 144.**

A preferred part of the construction of container **30*b* is a passageway 160 extending through the wall 38*b* separating the two compartments. As shown, the passageway can be located immediately adjacent the wall 146, or it may be located further up the dividing wall 38*b*. To close the passageway, the walls 148 and 144 are preferably sufficiently flexible as to permit the passageway to be closed merely by the application of force parallel to and aligned with the dividing wall 38*b*, as shown in FIG. 11. That is, the serum is caused to flow through passageway 160 into compartment 41*b* merely by tilting the container from an upright position to a horizontal position. Closure of passageway 160 occurs when a pressurizing means, such as plate 54, is placed in forcible contact with the sealing rib 56*b*.** Pressurization can then take place.

Figure 12:
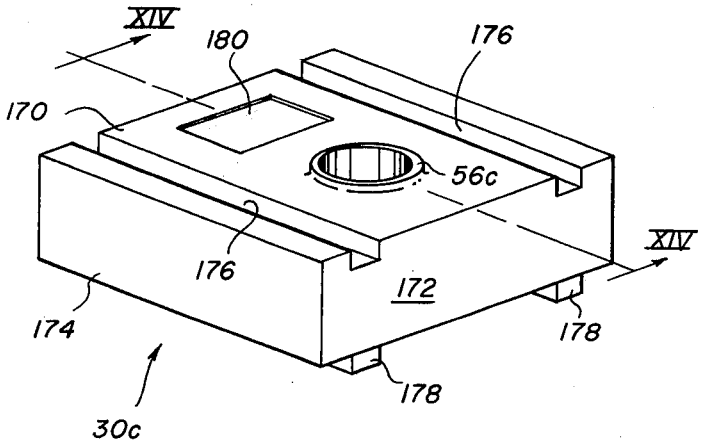
Figure 14:
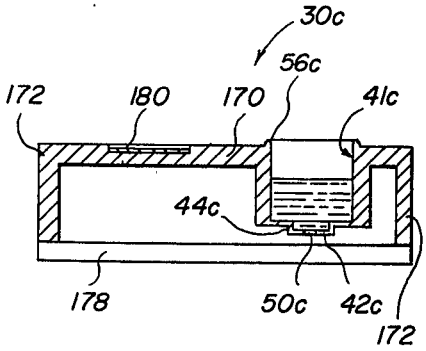

In FIGS. 12 and 14, the container **30*c* has been given a rectilinear form, which is more suited to stacking and automatic dispensing. Thus, although compartment 41*c* holds the serum to be dispensed in drop form from a platform 42*c* having an aperture 50*c* and side walls 44*c* as before, the container has in addition top wall 170 from which the compartment 41*c* is suspended, end walls 172, and side walls 174. A pair of generally parallel stacking grooves 176 and a pair of mating ribs 178 can be provided in the top wall and bottom surfaces of the end walls 172, it being immaterial which of these has the grooves and which the ribs. Further, an identification plate 180 may be impressed in the face of wall 170. Sealing rim 56*c*** on that face seals the compartment for pressurization, as in the previous embodiments.

Figure 13:
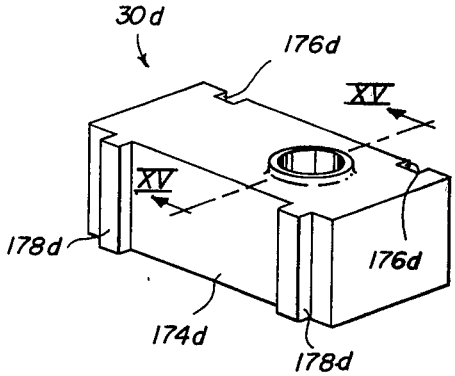
FIGS. 12–13 are isometric views of still two other embodiments of the container.
Figure 15:
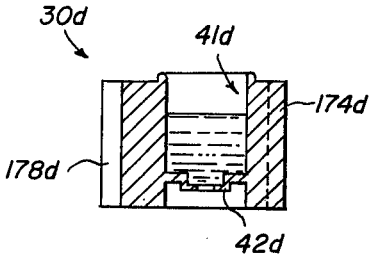
FIGS. 14–15 are elevational views in section of the containers shown in FIGS. 12 and 13, respectively, taken generally along the planes of XIV—XIV and XV—XV of FIGS. 12 and 13, respectively.

In FIGS. 13 and 15, the container **30*d* again has a rectilinear form, the difference being that the stacking and dispensing grooves 176*d* and ribs 178*d* are formed on the side walls 174*d*. Compartment 41*d* and platform 42*d*** are constructed as described above.

Figure 16:
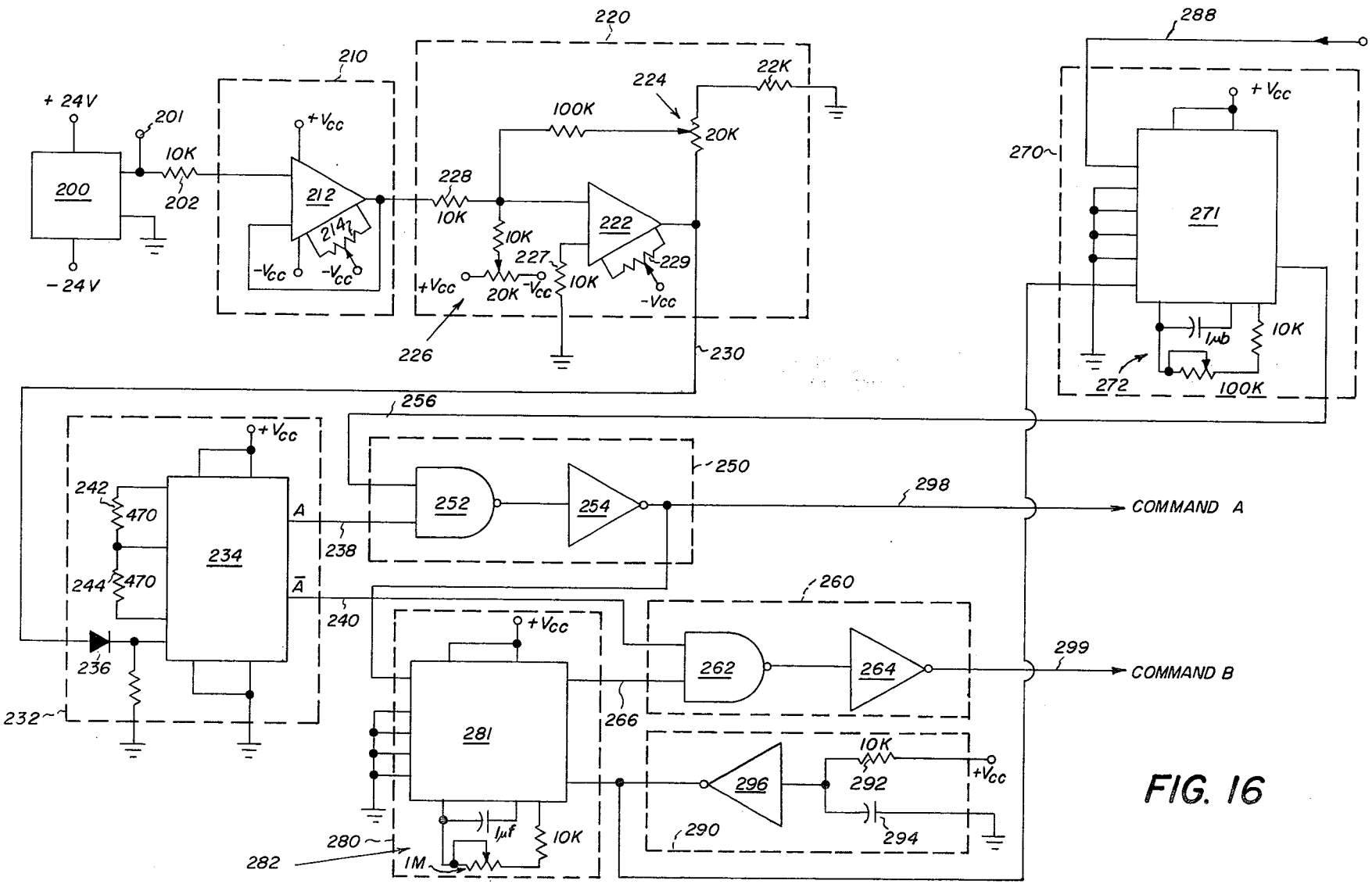
FIG. 16 is a schematic view of the failure mode control circuit constructed in accordance with the invention.

Turning now to FIG. 16, the failure mode detector preferably comprises a control circuit permitting the automatic control of the apparatus in response to the pressure levels in the container 30 measured via the passageway 72, that is, in response to the pressure both before and after the initiation of a properly formed drop. In general, control is achieved by the sensing of the pressure by a pressure transducer 200 for generating an analog signal, the voltage of which is generaly proportional to the pressure. A terminal 201 can be provided for a direct read-out of the pressure, as described below. Typically, the analog signal is fed through a resistor 202 to a buffer amplifier circuit 210, and thence to a variable gain amplifier circuit 220 having a bias level control 226. The amplified signal is transmitted via carrier 230 to a pulse generator 232 which is capable of generating a digital pulse when the amplified analog signal reaches a preset value determined by the setting of the variable amplifier's bias control 226. The pulse generator is connected to two "and" gates 250 and 260, each of which also receives a timed pulse from means such as a one-shot multivibrator circuit 270 or 280. The signal A delivered to gate 260 is the inverse of the signal A delivered to gate 250, as is well known. A power reset circuit 290 can be included to reset the multivibrators.

The transducer 200 can be, for example, a "Setra" pressure transducer, such as a "Setra Model 236" transducer, biased by a 24 volt DC source. The amplifier circuit 210 comprises an impedance matching, unity gain amplifier 212 and a variable resistor or potentiometer 214, as is well known. The amplifier circuit 220 is also conventional and comprises an operational amplifier 22, variable gain network 224, bias control network 226, resistors 228, and potentiometer 229. The pulse generator 232 can be any suitable analog-to-digital converter, such as a conventional "Schmitt" trigger 234 to which the analog signal is delivered. Diode 236 is incorporated to exclude negative analog signals. The signals A and A which are delivered by carriers 238 and 240, respectively, are either, in the case of A, a pulse having a value predetermined by the value of resistor 242, or a minimal "zero" value; and in the case of A, a minimal "zero" value, or a pulse the value of which is controlled by resistor 244. As shown, the pulses which can be delivered as signals A and A are preferably about equal.

The "and" gates 250 and 260, for convenience, comprise as shown a "nand" gate 252 or 256 in combination with a digital inverter 254 or 264, respectively. It will be appreciated, however, that a conventional "and" gate of any other construction can be substituted.

The second signal received by the "and" gates via carriers 256 and 266, respectively, comprises a timed pulse generated by the multivibrator 271 or 281 in circuits 270 or 280. Each of these multivibrators has a control circuit 272 and 282, respectively, which determines the length of the timed pulse so generated. An incoming signal is delivered by carrier 288 to multivibrator 270 to initiate the entire sequence.

The power reset circuit 290 comprises a resistor 292, a capacitor 294, and a digital inverter 296, and is automatically actuated when the aparatus is turned on so as to reset both the multivibrators to the proper initial condition.

The values shown for the resistors are in ohms, and are illustrative, only, of values which can be used. The values of "+Vcc" and "−Vcc" can be, for example, +10 volts and −10 volts, respectively.

Figure 18:
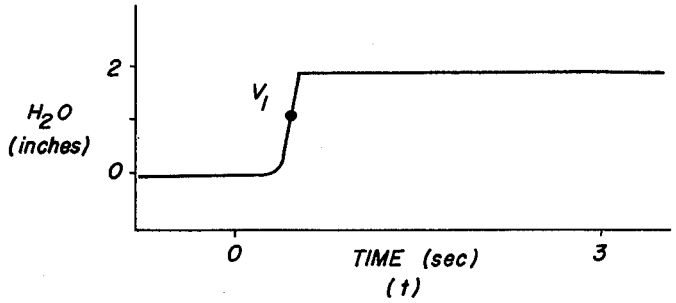
FIG. 18 is a chart similar to the chart of FIG. 17, but illustrating a non-normal drop sequence.

The sequence of operation will be apparent from the preceding description. FIGS. 17 and 18 illustrate typical pressure profiles measured at essentially constant temperature, for pressures within the container during dispensing, the profile of FIG. 17 being the normal profile. The peak of the curve of FIG. 17 represents a typical maximum pressure above ambient immediately prior to drop formation. The shape and value of the peak will vary somewhat depending on blood properties, temperature, and fluid residue on the platform. FIG. 18 in contrast in typical of non-drop formation or apparatus failure, conditions to be avoided. A "dispense signal" is delivered as the incoming signal on carrier 288, either by the operator or by the computer, and this represents time "*t*" = on FIG. 17 or 18. This may or may not coincide with actuation of the pressure generating means 51, and preferably does not so as to allow for a dwell time in the latter. Multivibrator 271 sends a timed pulse through carrier 256 to the "and" gate 250, the length of the pulse being controlled by circuit 272. In the meantime, the pressure transducer 200 is generating a signal via the amplifiers 210 and 220, and if it reaches a preset value $V_1$, shown in FIG. 17 as being less than 20 millivolts prior to amplification, and representing the build-up of the container pressure when the meniscus is outside the container but not yet expanding to form a drop, then the Schmitt trigger 232 will generate a pulse on carrier 238 which, in combination with the timed pulse from multivibrator 271, will cause "and" gate 250 to deliver a command pulse on carrier 298. That command pulse also serves to activate the one-shot multivibrator 281, which delivers a delayed timed pulse, delayed with respect to the initiation of the pulse from multivibrator 271, to the "and" gate 260. The delayed pulse, or both of the timed pulses, preferably have a life of from 1 to about 3 seconds. The "and" gate 260 will deliver a pulse on carrier 299 only if the A signal delivered by the generator 232 while the timed pulse is present, is a pulsed value. This will occur only if the voltage signal of FIG. 17 drops to a value $V_2$ such as 5 millivolts as shown, this value being representative of the container pressure during the formation of a properly formed drop. $V_2$ is preset and pre-controlled by the amplifier circuit 220 and the Schmitt trigger 234. If the voltage does drop to $V_2$, signal A becomes essentially zero. If, however, the A signal is zero, then only the timed pulse is delivered to gate 260. The carrier 299 thus delivers a null signal, which will inactivate or terminate the operation of the apparatus 20 by means such as a relay, not shown. Such a condition occurs when the pressure in container 30 follows the pattern shown in FIG. 18, and can be caused, for example, by a plugging of the platform aperture 50. A null signal delivered by carrier 298 will achieve the same result, representing the lack of pressure build-up in a container 30, as would be the case, for example, if no container is in position in the arm 60, or if the seal has not been maintained properly. In such a case, the pressure curve of FIG. 18 would never reach the $V_1$ value.

If desired, terminal 201 can be used to register the actual voltages being generated to provide, among other things, a ready means for drop volume calibration or recalibration.

It will be appreciated that alternative means, such as a properly programmed, conventional computer, can be used to generate and receive the signals on the input carriers 288 and the output carriers 298 and 299, respectively. Because such computers are conventional and well-known, further description herein is deemed unnecessary.

By means of the above-described circuitry and apparatus, proper performance of the pressurizing sequence is sensed by the use of only two pressure values.

Figure 19:
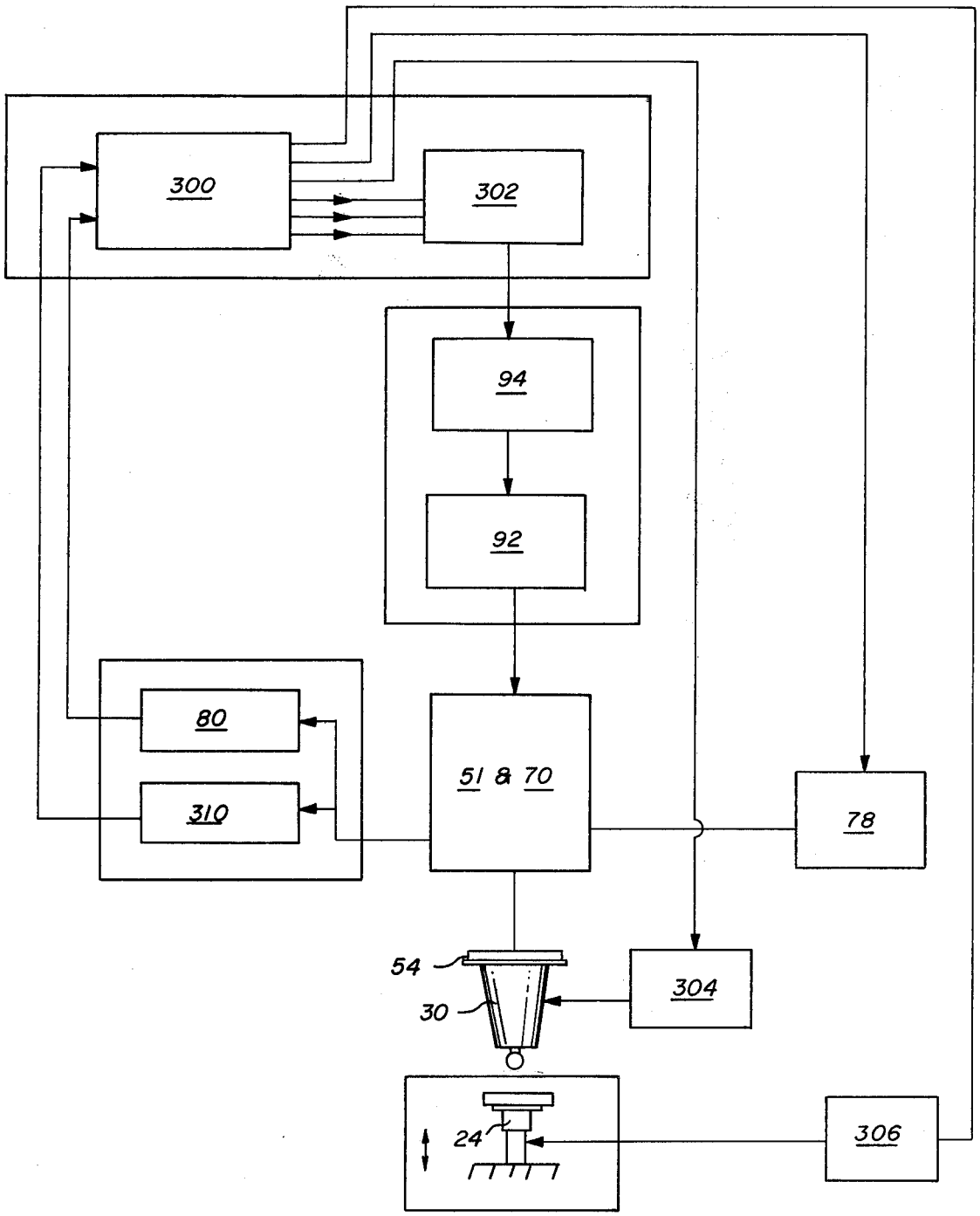
FIG. 19 is a flow diagram schematically illustrating the control of the apparatus.

Turning now to FIG. 19, there is schematically illustrated typical controls for operating the apparatus described above. A controller unit 300 feeds signals into a circuit 302 which controls the rotary motor 94, as well as into transfer and seating means 304 for feeding container 30 into place relative to the plate 54, and into the hydraulic motor 306 which activates the cylinder 24. Motor 94 in turn operates the rotary-to-linear converter 92, as described above, which causes pressurization in pressurizing means 51. Vent 70 is shown as being combined with means 51, as it is structurally and fluidly connected, the operation however of the vent means being controlled by motor 78 which is independently actuated by the controller unit. The pressurizing means-vent combination generates a feedback signal to failure mode detector 80, which in turn signals the unit 300 to continue the sequence of operation, such as by repeating the drop sequence for the formation of the next drop, or to stop operation, depending on the conditions as described with respect to FIG. 16. In addition, a conventional temperature sensor 310 can be added which will generate feedback concerning extreme temperatures which would render the failure mode detector 80, or the drop-forming sequence itself, inoperative.

All of the controller unit 300, circuit 302, transfer and seating means 304 and hydraulic motor 306 can be conventional devices, and do not require further description. For example, unit 300 can be a conventional computer, while means 304 includes arm 60 described above and a drive means for pivoting it into and out of position.

There can be included circuitry, not shown, for limiting the movement of substrate S so as not to be beyond that necessary to touch the drop on platform 42 onto the substrate, thus preventing contact of platform 42 with the substrate. A suitable limit switch is a typical example.

The invention has been defined in detail with reference to certain preferred embodiments thereof, but it will be understood that variations and modifications can be effected within the spirit and scope of the invention.

What is claimed is:

1. A container for the storage and dispensing of fluid, the container comprising a compartment having a capacity for the fluid sufficient to permit at least one drop to be dispensed therefrom, said compartment being defined by walls having inner and outer surfaces, one of said walls providing a platform on said outer surface, said platform having an aperture therein in fluid communication with said compartment and of dimensions which preclude gravity flow of the fluid from the container, and a drop-supporting surface defining a drop-wettable area which will support a completely-formed, pendant drop of predetermined volume, said volume being substantially fixed and within the range of about 1 and about 30 $\mu$l;

said platform being constructed in a manner which is sufficient to prevent the spreading of drops of dispensed fluid from said platform surface.

2. The container as defined in claim 1 wherein said platform aperture is generally circular and has a diameter between about 0.023 cm and about 0.045 cm.

3. The container as defined in claim 1 wherein said platform has a cross-sectional thickness taken along a plane at said aperture extending perpendicular to said platform, which thickness is no greater than about 0.025 cm.

4. The container as defined in claim 1 and further including a sealing shoulder extending generally perpendicularly away from said side walls.

5. The container as defined in claim 1 and further including indicia means for indicating the source of the fluid contained therein.

6. The container as defined in claim 1 and further including a connecting surface connecting said platform to, and outwardly spacing said platform away from, said outer surface.

7. The container as defined in claim 1 and further including a second compartment adjacent to said one compartment, said compartments being provided with at least one common wall between them, said common wall having a passageway therethrough providing fluid communication between said compartments, and means for closing said passageway.

8. The container as defined in claim 7 wherein the walls of said second compartment are sufficiently flexible as to permit the closing of said passageway by the application of a force parallel to and aligned with said common wall, towards said passageway.

9. The container as defined in claim 1 wherein said area is between about 0.0026 and about 0.0180 square centimeters.

10. A container for the storage and dispensing of a drop of fluid, the container comprising a bottom wall having an inner and an outer surface, and opposed side walls extending from said inner surface to define at least one compartment having a capacity for the fluid sufficient to permit at least one drop to be dispensed therefrom, said bottom wall having an aperture; and a platform connected to and spaced away from the said outer surface by a connecting surface, the distance between the platform and said outer surface being sufficient to prevent dispensed fluid from spreading from the platform to said outer surface;

at least a portion of the connecting surface being inclined at an angle with respect to said platform which will confine the drop to the platform, the transition zone between the platform and the connecting surface being sufficiently sharp as to form a confining edge which will confine the drop to said platform, said platform having an aperture in fluid communication with said bottom wall aperture, said aperture having dimensions which preclude gravity flow of a fluid from the container;

said platform further having a drop-supporting surface defining a drop-wettable area which will support a completely-formed, pendant drop of predetermined volume, said volume being substantially fixed and within the range of about 1 and about 30 $\mu$l.

11. The container as defined in claim 10 wherein said confining edge has a radius of curvature which is no greater than about 0.02 cm.

12. The container as defined in claim 10 wherein said platform surface is substantially flat, and said confining edge defines a generally circular area.

13. The container as defined in claim 12 wherein the diameter of said platform surface is at least about 0.05 cm.

14. Apparatus for dispensing liquids onto a substrate, comprising a support for the substrate;

a container provided with a platform at the bottom thereof suitable for the formation of pendant drops, said platform having an aperture permitting forced fluid flow from the interior of the container, the maximum dimension of the aperture being sufficiently small to prevent flow of the fluid under gravity;

mounting means for supporting the container spaced away from and above said support;

a passageway in fluid communication with the interior of said container;

means fluidly connected to said passageway for generating a pressure above ambient within said passageway;

said pressure generating means and said container mounting means being free from contact with the liquid being dispensed;

valve means permitting selective venting of said passageway to the atmosphere; and moving means for providing relative motion between said support and said container, whereby a drop formed on the platform by said generating means is deposited on the substrate by contact between the drop and the substrate.

15. The apparatus as defined in claim 14 and further including detecting means for detecting two different pressures within said container, the higher one of which represents at least a portion of the pressure required to commence formation of a drop of the fluid outside the container, and the lower one of which represents the pressure in the container during the formation of a properly formed drop of liquid on the platform, and means for inactivating at least one of said pressure generating means and said moving means if the two different pressures are not detected in the proper sequence and within a defined time limit.

16. The apparatus as defined in claim 15 wherein said detecting means include a pressure transducer responsive to the pressures within said container to develop a signal having a voltage corresponding to said pressures, at least one amplifier for amplifying said signal, and a pulse generator capable of generating a digital pulse when said signal reaches a preset value;

and said inactivating means include at least one timing means for generating a timed pulse and at least one logic circuit connected to said pulse generator and said timing means, capable of generating an inactivating signal if said digital pulse is not present when said timing pulse is present.

17. The apparatus as defined in claim 14 wherein said container further includes a bottom wall having an inner and an outer surface, and opposed side walls extending from said inner surface to define at least one compartment having a capacity for the liquid sufficient to permit at least one drop to be dispensed therefrom, said bottom wall having an aperture, a platform connected to and spaced away from the said outer surface by a connecting surface, the distance between the platform and said outer surface being sufficient to prevent dispensed liquid from spreading from the platfrom to said outer surface, the connecting surface being inclined at an angle with respect to said platform which will confine the drop to the platform, the transition zone between the exterior surface of the platform and the connecting surface being sufficiently sharp as to form an edge which will confine the drop to said exterior surface, said platform having a generally circular aperture in fluid communication with said bottom wall aperture, said aperture having a diameter smaller than that which will permit gravity flow from the container of a biological liquid, said platform exterior surface defining a drop-contacting area which will support a drop having a volume between about 1 and about 30 $\mu$l.

18. The apparatus as defined in claim 14 wherein said generating means include a second container the volume of which is alterable, and means for altering the volume of said second container.

19. The apparatus as defined in claim 18 wherein said pressure generating means includes a collapsible bellows, and said volume altering means includes a linearly movable drive in contact with said bellows.

20. The apparatus as defined in claim 19 and further including a rotary motor and a rotary to linear converter for operating said bellows drive.

21. The apparatus as defined in claim 14 wherein said pressure generating means include a piston member comprising a piston rod and a cylinder within which said rod is mounted for reciprocation, the interior of the cylinder being in sealed communication with the interior of said container.

22. The apparatus as defined in claim 21 wherein said pressure generating means include a rotary motor and a rotary to linear converter connected to said piston rod.

23. Apparatus for pressurizing a dispensing container including a drop-forming platform having an aperture permitting forced liquid flow from the interior of the container, the maximum dimension of the aperture being sufficiently small to prevent flow of the liquid under gravity; the apparatus comprising mounting means for removably mounting the container;

a passageway capable of fluid communication with the interior of the container;

means connected to said passageway for generating an air pressure above ambient within said passageway;

said pressure generating means and said container mounting means being free from contact with the liquid being dispensed;

detecting means for detecting two different pressures within the container, the higher one of which represents at least a portion of the pressure required to commence formation of a drop of the fluid outside the container, adjacent to the platform, and the lower one of which represents the pressure in the container during the formation of a drop of fluid on the platform;

and means operatively associated with said detecting means for inactivating the apparatus if the two different pressures are not detected in the proper sequence and within a defined time limit.

24. The apparatus as defined in claim 23 wherein said detecting means include a pressure transducer responsive to the pressures within said container to develop a signal having a voltage corresponding to said pressures, at least one amplifier for amplifying said signal, and a pulse generator capable of generating a digital pulse when said signal reaches a preset value;

and said inactivating means include at least one timing means for generating a timed pulse and at least one logic circuit connected to said pulse generator and said timing means, capable of generating an inactivating signal if said digital pulse is not present when said timing pulse is present.

25. The apparatus as defined in claim 23 wherein said generating means include a second container the volume of which is alterable, and means for altering the volume.

26. A process for the precise dispensing onto a substrate of a drop of a fluid having a surface tension which varies from between about 35 dynes/cm and about 75 dynes/cm, the process comprising the steps of depositing the fluid in an open-top container having a dispensing aperture the maximum dimension of which is less than that which will permit gravity flow of the fluid;

pressurizing the air in the top of said container and thus the fluid in an amount sufficient to form a pendant drop outside the container at the aperture while maintaining the fluid free of contact with apparatus other than the container, and while maintaining the container stationary, moving the substrate into contact, so as to cause removal of the drop onto the substrate.

27. The process as defined in claim 26 and further including the steps of detecting within a prescribed time limit a pressure increase within the container; and detecting within said time limit a pressure decrease within said container, both pressure changes being those which correspond to said drop formation, and in the absence of said pressure increase or pressure decrease, of terminating the process 28. The process as defined in claim 27 wherein said time limit is no greater than about 3 seconds.

29. The process as defined in claim 26 and further including the step of returning the pressure in the interior of the container to atmospheric value after the removal of the drop.

30. The process as defined in claim 26 wherein said pressurizing step comprises the step of increasing the air pressure above the fluid by between about 1.5 and about 2 inches of water, and wherein the drop has a volume of about 10 μl.

31. A process for the precise dispensing onto a substrate of a drop of a fluid having a surface tension which varies from between about 35 dynes/cm and about 75 dynes/cm, the process comprising the steps of depositing the fluid in an open-top container having a dispensing aperture the maximum dimension of which is less than that which will permit gravity flow of the fluid;

positioning a second, volume-alterable container in fluid communication with the top of said open-top container;

collapsing the second container an amount sufficient to form a pendant drop outside the container at the aperture while maintaining the fluid free of contact with apparatus other than the container; and while maintaining the container stationary, moving the substrate into contact, so as to cause removal of the drop onto the substrate.

32. A container for the storage and dispensing of a drop of blood serum of widely varying properties, the container comprising a bottom wall having an inner and an outer surface, and opposed side walls extending from said inner surface to define at least one compartment having a capacity for the serum sufficient to permit at least one drop to be dispensed therefrom, said bottom wall having an aperture; and a platform connected to and spaced away from the said outer surface by a connecting surface, the distance between the platform and said outer surface being sufficient to prevent dispensed serum from spreading from the platform to said outer surface;

at least a portion of the connecting surface being inclined at an angle with respect to said platform which will confine the drop to the platform, the transition zone between the platform and the connecting surface being sufficiently sharp as to form a confining edge which will confine the drop to said platform, said platform having an aperture in fluid communication with said bottom wall aperture, said aperture having dimensions which preclude gravity flow of the serum from the container;

said platform further having a drop-supporting surface defining a drop-wettable area which will support a completely-formed, pendant drop of predetermined volume, said volume being within the range of about 1 and about 30μl and predictably, substantially invariant over a range of surface tension and relative viscosity of between about 35 and about 75 dynes/cm, and about 0.9 and 2.0, respectively.

* * * * *

UNITED STATES PATENT AND TRADEMARK OFFICE

CERTIFICATE OF CORRECTION

PATENT NO. : 4,041,995

DATED : August 16, 1977

INVENTOR(S) : Richard L. Columbus

It is certified that error appears in the above-identified patent and that said Letters Patent are hereby corrected as shown below:

Title page, column 2, item [56], line 4, "Schiya" should read --Schira--; line 8, "Lafour" should read --deLatour--.

Column 3, line 40, "l" (second occurrence), appearing to be the figure one, should read --1--, meaning the letter el.

Column 4, line 19, "planes of" should read --planes--; line 65, "this" should read --the--.

Column 5, line 17, "10" should read --20--.

Column 6, line 19, "betweem" should read --between--; line 40, "fo" should read --to--.

Column 7, line 33, "l" (second occurrence), appearing to be the figure one, should read --1--, meaning the letter el; line 34, "l", appearing to be the figure one, should read --1--, meaning the letter l.

Column 8, line 20, "that" should read --than--.

Column 9, line 2, "X" should read --$\bar{X}$--; line 3, "an" should read --and--; line 34, "while" should read --whole--.

Column 11, line 40, "in" should read --if--.

Column 13, line 51, "generaly" should read --generally--; line 65, "A" should read --$\bar{A}$--.

Column 14, line 8, "22" should read --222--; line 14, "A" (second occurrence) should read --$\bar{A}$--; line 17, "A" should read --$\bar{A}$--; line 20, "A" (second occurrence) should read --$\bar{A}$--; line 22, "256" should read --262--; line 57, "= on" should read --= 0 on--.

UNITED STATES PATENT AND TRADEMARK OFFICE

CERTIFICATE OF CORRECTION

PATENT NO. : 4,041,995

DATED : August 16, 1977

INVENTOR(S) : Richard L. Columbus

It is certified that error appears in the above-identified patent and that said Letters Patent are hereby corrected as shown below:

Column 15, line 11, "A" should read --Ā--; line 20, "A" should read --Ā--.

Column 18, line 42 "platfrom" should read --platform--.

Signed and Sealed this

Seventh Day of February 1978

[SEAL]

Attest:

RUTH C. MASON
Attesting Officer

LUTRELLE F. PARKER
Acting Commissioner of Patents and Trademarks